US006934223B2

(12) United States Patent
Martin et al.

(10) Patent No.: US 6,934,223 B2
(45) Date of Patent: Aug. 23, 2005

(54) ANALOGUE ELECTRONIC WATCH HAVING A DEVICE FOR RESETTING THE TIME FOLLOWING A POWER SHORTAGE

(75) Inventors: Jean-Claude Martin, Montmollin (CH); Jean-Charles Guanter, Diesse (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/450,853

(22) PCT Filed: Nov. 29, 2001

(86) PCT No.: PCT/EP01/14208

§ 371 (c)(1),
(2), (4) Date: Jun. 18, 2003

(87) PCT Pub. No.: WO02/50617

PCT Pub. Date: Jun. 27, 2002

(65) Prior Publication Data

US 2004/0027925 A1 Feb. 12, 2004

(30) Foreign Application Priority Data

Dec. 18, 2000 (EP) ..... 002045797

(51) Int. Cl.[7] ..... G04C 3/00
(52) U.S. Cl. ..... 368/204; 368/203
(58) Field of Search ..... 368/203–204

(56) References Cited

U.S. PATENT DOCUMENTS 5,280,459 A * 1/1994 Nakamura ..... 368/80
5,457,664 A 10/1995 Izukawa et al.
6,061,304 A * 5/2000 Nagata et al. ..... 368/66
6,144,622 A * 11/2000 Berney ..... 368/204
6,194,878 B1 * 2/2001 Schafroth ..... 322/29

FOREIGN PATENT DOCUMENTS

| | | |
|---|---|---|
| EP | 0 855 633 A | 7/1998 |
| EP | 0 919 887 A | 6/1999 |
| EP | 1 014 227 A | 6/2000 |
| WO | WO 98/33098 | 7/1998 |

* cited by examiner

*Primary Examiner*—Kamand Cuneo
*Assistant Examiner*—Thanh S. Phan
(74) *Attorney, Agent, or Firm*—Griffin & Szipl, P.C.

(57) ABSTRACT

The electronic watch includes analogue display means (1) formed of at least one hand (2) driven by at least one motor (3), a time base (4) for controlling means (8) for driving said motor, a rechargeable power source (9), means (14) for stopping the motor (3) acting particularly on said drive means, and time counting means (18) in synchronism with said analogue display means (1) for a sufficient supply voltage. When the stopping means detect a power shortage, the display means are stopped and the corresponding value of the counting means is stored in storage means and the counting means continue to operate. As soon as the power supply is sufficient again, time difference calculating means (20) send time difference signals (21) between the stored value and the value of the counting means to the drive means in order to reset said analogue display means to the right time.

10 Claims, 2 Drawing Sheets

ANALOGUE ELECTRONIC WATCH HAVING A DEVICE FOR RESETTING THE TIME FOLLOWING A POWER SHORTAGE

This is a National Stage of International Application No. PCT/EP01/14208, filed on Nov. 29, 2001, which claims priority of EP-00204579.7 filed on Dec. 18, 2000. The entire disclosures of the above applications are hereby incorporated by reference.

FIELD OF THE INVENTION

The present invention concerns an electronic watch which includes analogue display means formed of at least one hand driven by at least one motor, a time base for controlling means for driving said motor, a rechargeable power source, means for stopping the motor acting particularly on said drive means and means for counting time in synchronism with said analogue display means when the source supplies a sufficient supply voltage.

BACKGROUND OF THE INVENTION

A watch including means for detecting a power shortage for the motor is known particularly from Patent document No. WO 98/33098. This document presents an electronic watch having hands driven by a motor and controlled by electronic means containing time related data, a power source and means for detecting power shortage of this source. In the event of power shortage, the hands are brought to and kept at reference positions programmed in advance in the electronic means.

This watch has, however, some drawbacks. Indeed, the hands of the watch are the reflection of the electronic means counter value. This is why it is necessary to bring the hands into a reference position, when there is a power shortage, to force the value of this counter to a reference value programmed before the watch is set into operation. Thus, this counter synchronised with the hands can no longer be used as a time counter. It is thus necessary to have a second counter, which counts time during a power shortage. However, during normal operation of the watch, which represents most of the operating time, the two counters contain the same values. These two counters unnecessarily complicate the electronic means of the watch.

It is thus a main object of the invention to overcome the drawbacks of the aforementioned prior art by providing an electronic watch which includes simplified electronic means that do not require any reference value to be programmed in order to reset the time following a power shortage.

SUMMARY OF TILE INVENTION

The invention therefore concerns an electronic watch of the type mentioned in the introduction which is characterised in that when a power shortage is detected by said stopping means, said display means are stopped and the corresponding value of said counting means is stored in storage means, said counting means continuing to operate, and in that, as soon as the power supply is again sufficient, means for calculating a time difference send signals of the time difference between the stored value and the counting means value to said drive means in order to reset the time of said analogue display means.

Advantageously, said means for stopping the motor are activated for a first threshold voltage corresponding to detection of a power shortage of the motor and they are kept activated as long as a second threshold voltage higher than the first threshold voltage has not been reached by the power source, which avoids problems linked to the variation in supply voltage due to load changes when elements such as the motor stop.

This second threshold voltage corresponds to a determined charge level of the power source.

Indeed, when one of the power consuming elements such as the motor stops, it is common for the voltage level of rechargeable power sources of the battery or accumulator type to vary slightly. This variation in the supply voltage is a phenomenon known to those skilled in the art. When the power source charge becomes insufficient to provide the current necessary for the watch to operate, if a power consuming element, such as the motor, stops, this causes a strong drop in load and current requirements, which causes a variation in the supply voltage. This discontinuity in the discharge of the power source creates, as shown in FIG. 3, a transition period (t1, t1+dt), during which the motor is stopped then started several times in a row until the voltage level is insufficient to activate the motor again. This transition period prematurely wears out the parts of the watch, which are thus activated and then stopped. Moreover, the user might think his watch is malfunctioning when he sees the hands stop, move into a reference position and move again several times in a row.

According to a variant of the invention, it is possible, when a power shortage is detected, to provide a sufficient period of time to keep the stop means activated to avoid the load change effects of the power source between t1 and t1+dt described hereinbefore.

The storage means could be formed particularly of a non-volatile memory.

BRIEF DESCRIPTION OF THE DRAWINGS

Other features and advantages of the present invention will appear in the following description, given by way of example and made with reference to the annexed drawings, in which.

DETAILED DESCRIPTION OF THE INVENTION

Figure 1:
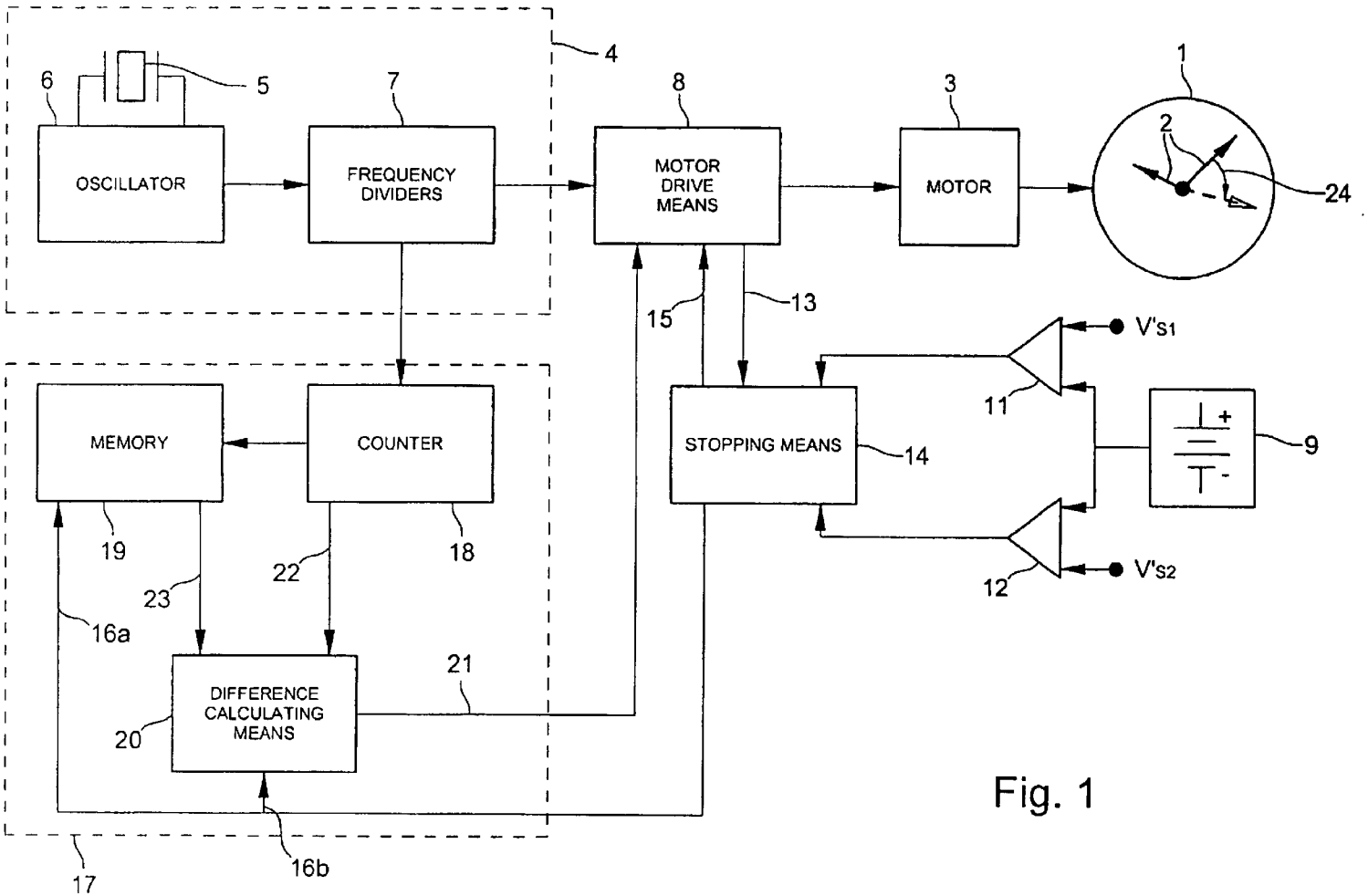
FIG. 1 shows a view of the whole of the time setting device according to a preferred embodiment of the invention.

FIG. 1 shows the elements of the watch necessary for comprehension of the invention. The electronic watch includes analogue display means 1 generally formed of at least two hands 2. One is used to indicate the hours and the other the minutes. It is possible to provide a third hand used, for example, to indicate the seconds.

Hands 2 are driven by at least one motor 3. Preferably the hour hand and the minute hand are driven by a stepping motor and the second hand is driven by another stepping motor. In fact, for the sake of saving energy, the motor driving the second hand could be stopped earlier.

The arrangement of the motors and the gear trains for driving the hands will not be described here. Indeed, watch movements including several motors for activating the hands, for example individually, are already known.

A time base 4 defines for each motor 3 the step for moving forward the hand 2 associated with said motor. Time base 4, generally used, is formed of a quartz oscillator, referenced 5 and 6, and of various frequency divider stages 7 of oscillator 6 for driving each motor 3 with the desired step. Drive means 8 for motor or motors 3 are provided for this purpose.

Motor 3 is powered by a rechargeable power source 9 of the accumulator or battery type. This power source 9 could be recharged in different ways, particularly by using photovoltaic cells, an oscillating mass, or by electric contacts. This latter method will preferably be used to satisfy a quick and complete recharging requirement.

Voltage comparators 11 and 12 are placed at the output of power source 9. They receive at input a fraction of the supply voltage obtained by a voltage divider, for example a resistive bridge, and a voltage $V'_{S1}$, respectively $V'_{S2}$. These voltages mirrors the threshold voltages $V_{S1}$ and $V_{S2}$ (see FIGS. 2 to 4).

$V_{S1}$ corresponds to a voltage sufficient to ensure synchronisation between the time indication of analogue display 1 and the pulses supplied by time base 4 to drive means for motor 8. Typically, the value of this voltage is selected with a safety factor with respect to the minimum voltage necessary for motor 3 to operate properly.

$V_{S2}$ corresponds to a charge level determined such that the charge is deemed sufficient to restart the motor. The latter could still operate properly below this voltage. This second threshold voltage also allows the effects discussed with reference to FIG. 3 to be avoided.

Mirror voltages $V'_{S1}$ and $V'_{S2}$ are obtained by means of a conventional circuit known to those skilled in the art. This circuit, which is not shown, includes means for providing a reference voltage to which a voltage divider resistive bridge is applied, defining the two voltages $V'_{S1}$ and $V'_{S2}$. These two voltages are thus lower than threshold voltages $V_{S1}$ and $V_{S2}$.

Comparator 11, respectively 12, compares the fractioned supply voltage with mirror voltage $V'_{S1}$, respectively $V'S_2$. These comparison means 11 and 12 are operational while the supply voltage is higher than a minimum voltage $V_{OUT}$ (see FIG. 4).

Advantageously, switching means, which are not shown, are provided, leaving only comparator 11 active when power source 9 is discharged, and conversely leaving comparator 12 active when power source 9 is charged.

Means 14 for stopping the motor collect the results of the comparisons. These means particularly allow a power shortage in power source 9 to be detected. Depending upon the state of supply and depending upon the preceding state of the motor provided by a signal 13, these stopping means 14 will send to drive means 8 a state of the motor control signal 15, which will either be a motor stopping signal, or a motor starting signal. The evolution of these states of the motor as a function of the comparisons carried out by comparators 11 and 12 will be studied in detail in FIG. 2.

The motor stopping means are in particular connected to a time resetting circuit 17. This time resetting circuit 17 is formed of at least one counter 18 for counting time in accordance with the pulses received by the time base 4, storage means formed of at least one memory 19 for storing the content of counter 18 and means for calculating the time difference 20 for obtaining the shift 24 between the position of hands 2 and the exact time.

Counter 18 operates permanently, while power source 9 delivers a minimum voltage $V_{OUT}$ sufficient to supply time base 4 and made said counter 8 operate. Below this voltage $V_{OUT}$ none of the functions are guaranteed to operate properly. In general, this voltage $V_{OUT}$ is considerably lower than first threshold voltage $V_{S1}$, which leaves the user a sufficient time lag, for example, a minimum of several hours, to take account of the power shortage, hands 2 being stopped. The user can then recharge the accumulator or battery 9 while keeping exact time information.

When there is a power shortage, motor 3 is stopped as well as hands 2. Stopping means 14 then send information signal 16*a* concerning the stopping of the motor to a memory 19. The value then contained in counter 18 is stored in memory 19. Preferably, a non-volatile memory 19 is used.

When motor 3 is started again, an information signal 16*b* is sent to difference calculating means 20. Thus, these means 20 carry out a subtraction from the current value 22 of counter 18 and the value 23 stored in memory 19. The result obtained is in the form of time difference signals 21 which are sent to motor drive means 8 in order to reset hands 2 to the right time. Hands 2 are brought to the right time via the quickest route. Depending on the value of the difference, drive means 8 command motor 3 to rotate in one direction or the other.

An embodiment example could be as follows:

1. 0 hours≦(current time−stored time)<6 hours rotation: clockwise;
2. 6 hours≦(current time−stored time)<12 hours rotation; anticlockwise
3. −12 hours<(current time−stored time)≦−6 hours rotation: clockwise
4. −6 hours<(current time−stored time)<0 hour rotation: anticlockwise Other embodiments for bringing the hands to the right time by the shortest route may also be envisaged.

Figure 2:
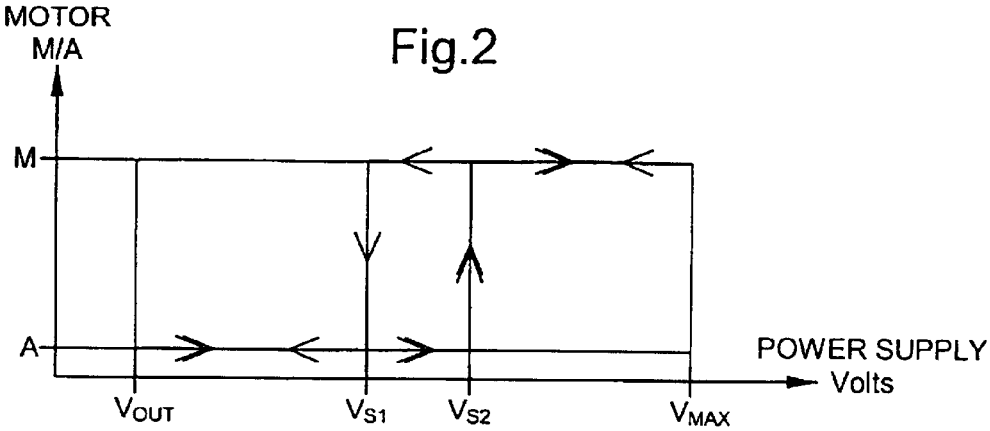
FIG. 2 shows the state of the motor as a function of the voltage delivered by the power source.

FIG. 2 shows the operation of the motor stopping means 14 as a function of the comparisons made by comparators 11 and 12 and as a function of the state of motor 15, seen in FIG. 1.

The X-axis shows the supply voltage delivered by source 9. This voltage can vary between 0 and $V_{MAX}$. The zero voltage corresponds to the voltage delivered when battery or accumulator 9 is totally discharged. Voltage $V_{MAX}$ correspond to the maximum voltage delivered when the battery or accumulator is completely charged. Voltage $V_{OUT}$, defined earlier, corresponds to the minimum voltage for which the data of counter 18 is exact. Voltages $V_{S1}$ and $V_{S2}$ correspond to the two threshold voltages whose associated mirror voltages $V'_{S1}$ and $V'_{S2}$ allow the state of the motor to be controlled.

The Y-axis shows the state of the motor. If the state corresponds to A, the motor has stopped. If the state corresponds to M, the motor is operating.

Starting from a maximum state of charge of power source 9, the voltage delivered is $V_{MAX}$. At this supply voltage, the energy provided is sufficient, the motor is thus working, i.e. at state M.

With time and the use of the time functions of the watch, the battery or accumulator 9 discharges. When the supply voltage becomes lower than threshold voltage $V_{S1}$, the energy supplied by the power source is no longer sufficient to ensure synchronisation between time base 4 and the time indication of hands 2. Motor stopping means 14 are activated and motor 3 is stopped via motor drive means 8. Motor 3 passes to state A.

Once motor 3 has stopped, hands 2 are also stopped. The value of time counter 18 is stored, the counter continuing to operate. Most of the energy consumed by the device is the energy consumed by the motor. When the motor stops, the consumption becomes very low. This is why the watch can still calculate the time during the entire period of time when the supply voltage is less than $V_{S1}$ but greater than $V_{OUT}$.

When the user sees that hands 2 have stopped, he knows that battery or accumulator 9 has to be recharged. During recharging of power source 9, motor 3 is only restarted from a second threshold voltage $V_{S2}$ greater than $V_{S1}$ and corresponding to a determined minimum recharge level. Stopping means 14 remain activated, during recharging, for a value comprised between $V_{S1}$ and $V_{S2}$, since the state of the motor is at A.

Figure 3:
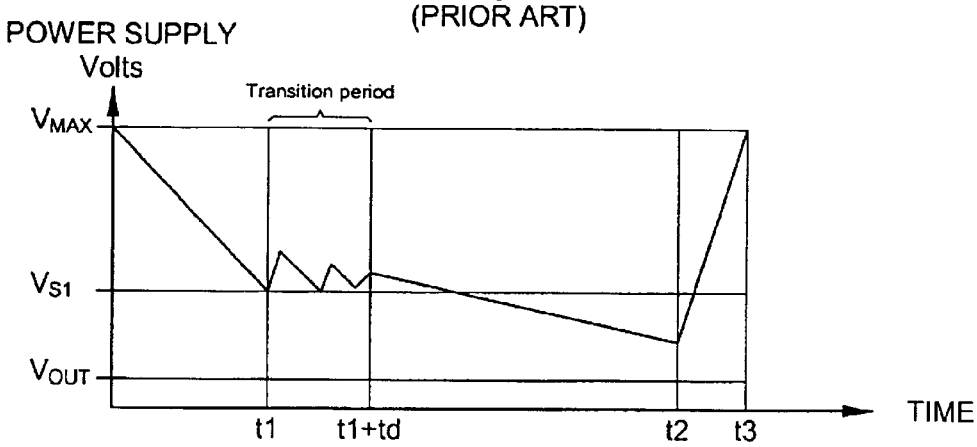
Fig.3 (PRIOR ART)
FIG. 3 shows a discharge/recharge period of the power source in a device of the prior art.
Figure 4:
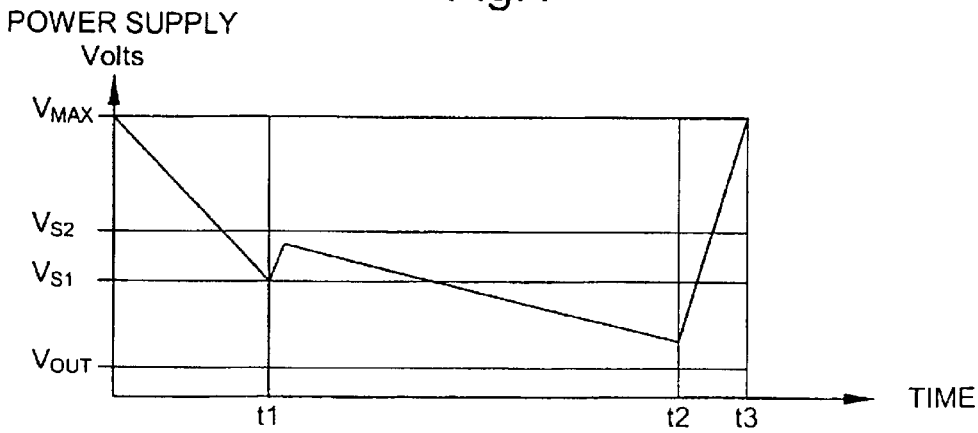
FIG. 4 shows a discharge/recharge period of the power source in a device according to the invention.

FIGS. 3 and 4 show a conventional discharging/recharging cycle of power source 9 over time, according to the prior art (FIG. 3) and according to the invention (FIG. 4).

As was described in the introduction of this description, a device according to FIG. 3, causes the creation of a transition period which one wishes to avoid.

Indeed, during discharging, when the supply voltage becomes less than threshold voltage $V_{S1}$, at t1, the motor is stopped. The motor is the main power consumer of the device. This is why, when it is stopped, the load powered by the battery is greatly decreased.

The supply voltage again becomes greater than $V_{S1}$. At the same time, the result of comparator 11 between the fraction of the supply voltage and the associated mirror voltage $V'_{S1}$, controlling not only the stopping, but also the working of the motor, again becomes positive, thus, the motor is restarted directly after it was stopped. There then exists a transition period during which the motor and thus the hands are stopped then restarted several times in a row. This period ceases, at t1+dt, when the overvoltage is no longer sufficient to restart the motor.

In a device according to the invention, as in FIG. 4, two mirror voltages $V'_{S1}$, and $V'_{S2}$ are used, associated with threshold voltages $V_{S1}$ and $V_{S2}$ to manage motor stopping means 14 which enables the aforementioned drawback, common in devices of the prior art provided with a battery or accumulator 9, to be avoided.

In order to do this, a second threshold voltage $V_{S2}$ greater than $V_{S1}$, is provided. The value of $V_{S2}$ is taken such that it is greater than voltage $V_{S1}$, to which the overvoltage due to stopping the main consumer, is added, i.e. when motor 3 is stopped.

Thus, the drawbacks linked to variation in the supply voltage due to load changes are avoided. Power source 9 passes directly into an operating mode that consumes less energy. This is why, the discharge slope is considerably less pronounced between instants t1 and t2. Instant t2 represents the moment when the user realises that hands 2 of his watch have stopped and decides to recharge the battery or accumulator 9. Recharging is represented between instants t2 and t3.

According to a variant of the invention, it is also possible, when a power shortage is detected, to provide a period of time sufficient to avoid the effects of the load change between t1 and t1+dt, shown in FIG. 3. This period of time may be programmed in accordance with the requirements of a user.

Of course, other embodiments of an electronic watch according to the invention could also be described within the knowledge of those skilled in the art, without departing from the scope of the invention defined by the claims.

What is claimed is:

1. An electronic watch including analogue display means formed of at least one hand driven by at least one motor, a time base for controlling means for driving said motor, a rechargeable power source, means for stopping the motor acting particularly on said drive means, time counting means in synchronism with said analogue display means for a sufficient supply voltage, wherein when said stopping means detect a power shortage, said display means are stopped and the corresponding value of said counting means is stored in storage means, said counting means continuing to operate, wherein, as soon as the power supply is sufficient again, time difference calculating means send time difference signals between the stored value and the value of the counting means to said drive means in order to reset said analogue display means to the right time, and wherein depending on the value of the time difference, said drive means commands the motor to rotate in one direction or the other according to the following calculation:

0 hours<(current time−stored time)<6 hours, or 12 hours<(current time−stored time)<−6 hours, then the motor rotates clockwise and 6 hours<(current time−stored time)<12 hours, or 6 hours<(current time−stored time)<0 hour, then the motor rotates anti-clockwise.

2. An electronic watch according to claim 1, wherein said motor stopping means is activated for a first threshold voltage corresponding to detection of a power shortage for the motor, wherein the motor stopping means is kept activated as long as a second threshold voltage greater than the first threshold voltage has not been reached by the power source.

3. An electronic watch according to claim 2, wherein the second threshold voltage corresponds to a determined charge level of the power source.

4. An electronic watch according to claim 1, wherein said stopping means are kept activated during a period of time sufficient to avoid the load change effects in the power source, upon detection of a power shortage.

5. An electronic watch according to claim 1, wherein the display means are reset to the right time, when the motor stopping means are deactivated, by the shortest route.

6. A method for resetting the time following a power shortage in a timepiece, comprising the steps of:

(a) providing an electronic watch comprising an analogue display means including at least one hand driven by at least one motor, a time base for controlling means for driving the motor, a rechargeable power source, means for stopping the motor acting particularly on said drive means, a time counting means in synchronism with said analogue display means for a sufficient supply voltage, and a time difference calculating means connected to the counting means and the drive means;

(b) detecting a power shortage with the stopping means so that when the stopping means detects a power shortage, the display means are stopped, a corresponding value of the counting means is stored in the storage means, and the counting means continues to operate; wherein at a time when the power shortage is corrected, the time difference calculating means sends time difference signals to the drive means in order to reset the analogue display means to the right time, and (c) depending on the value of the time difference, said drive means commands the motor to rotate in one direction or the other according to the following calculation:

0 hours<(current time−stored time)<6 hours, or 12 hours<(current time−stored time)<6 hours then the motor rotates clockwise; and 6 hours<(current time−stored time)<12 hours, or 6 hour<(current time−stored time)<0 hour, then the motor rotates anti-clockwise.

7. A method according to claim 6, further comprising a step that when said display means are stopped, the display means remain in a position in which said display means were disposed at the time said display means were stopped.

8. An electronic watch according to claim 1, wherein when said display means are stopped, the display means remain in a position in which said display means were disposed at the time said display means were stopped.

9. An electronic watch comprising:

analogue display means formed of at least one hand connected to be driven by at least one motor;

means for driving the at least one motor connected to drive the at least one motor;

a time base connected to control the means for driving the at least one motor;

a rechargeable power source connected to power the at least one motor;

means for stopping the motor connected between the power source and the drive means, wherein the means for stopping the motor acts on drive means by inputting a motor control signal; and time counting means connected to receive input from the time base in synchronism with the analogue display means while the power source delivers a minimum first supply voltage, wherein the time counting means is connected to send input to a storage means;

wherein when the stopping means detects the power source delivering supply voltage greater than the first supply voltage and less than a first threshold voltage, wherein the first threshold voltage is greater than the first supply voltage, then a power shortage has occurred and the stopping means stops the display means and the corresponding value of the counting means is stored in the storage means while the counting means continues to operate, and when the power source again delivers supply voltage greater than the first threshold voltage, then the time stopping means sends a signal to time difference calculating means, wherein the time difference calculating means forms time difference signals by subtracting the stored value from the value of the counting means, and the time difference calculating means is connected to send the time difference signals to the drive means in order to reset the analogue display means to the right time.

10. An electronic watch according to claim 9, wherein said drive means operates to drive motor rotation in one direction or the other, depending on the value of the time difference, according to the following:

0 hours<(current time−stored time)<6 hours, or 12 hours<(current time−stored time)<6 hours, then the motor rotates clockwise; and 6 hours<(current time−stored time)<12 hours, or 6 hours<(current time−stored time)<0 hour, then the motor rotates anti-clockwise.

* * * * *